US006293825B1

(12) United States Patent
Huang

(10) Patent No.: US 6,293,825 B1
(45) Date of Patent: Sep. 25, 2001

(54) ELECTRICAL CONNECTOR

(75) Inventor: Nan Tsung Huang, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/507,569

(22) Filed: Feb. 18, 2000

(30) Foreign Application Priority Data

Dec. 30, 1999 (TW) ..... 088222451

(51) Int. Cl.[7] ..... H01R 13/648
(52) U.S. Cl. ..... 439/607
(58) Field of Search ..... 439/607–610

(56) References Cited

U.S. PATENT DOCUMENTS 5,738,544 * 4/1998 Davis ..... 439/607
5,755,595 * 5/1998 Davis et al. ..... 439/607
5,797,770 * 8/1998 Davis et al. ..... 439/607
5,928,035 * 7/1999 Jankowsky et al. ..... 439/607
6,077,120 * 6/2000 Futatsugi et al. ..... 439/607
6,083,046 * 7/2000 Wu et al. ..... 439/607
6,086,429 * 4/2000 Wu ..... 439/607

* cited by examiner

*Primary Examiner*—Gary F. Paumen
(74) *Attorney, Agent, or Firm*—Wei Te Chung

(57) ABSTRACT

An electrical connector comprises an insulative housing including a body and an engaging section together defining a plurality of passageways for receiving a plurality of terminals therein. A substantially rectangular shell is made from a metallic material. The shell includes a ceiling portion, a bottom portion and a first and second side walls. The shell defines a receiving space for accommodating the insulative housing therein. The ceiling portion defines a retaining hole for engaging with an inserted mating plug. A pair of retention arms is respectively formed in the first and second side walls. Two pairs of soldering pads respectively extend from the lower edge of the first and second side walls for soldering to a printed circuit board.

2 Claims, 5 Drawing Sheets

ELECTRICAL CONNECTOR

BACKGROUND OF THE INVENTION

The present invention relates to an electrical connector, and particularly to an electrical connector having a metallic shell for providing EMI protection and for soldering onto a printed circuit board.

U.S. Pat. Nos. 5,738,544, 5,755,595, and 5,797,770 each disclose a conventional electrical connector which is adapted to be mounted to the printed circuit board where the rear portion of the connector is seated around the front edge portion of the printed circuit board while the front portion of the connector projects beyond the front edge of the printed circuit board with a distance. Referring to FIG. 5, an electrical connector 1 has a metal shield 10 for receiving an insulative housing 12 therein. A plurality of terminals (not shown) is received in corresponding passageways defined in the insulative housing 12. A pair of retention legs 14 is formed at lateral sides of the metal shield 10 for extending through a pair of mounting holes defined in the printed circuit board for mounting the electrical connector 1 onto the circuit board. Thus this connection requires that a pair of mounting hole defined in the printed circuit board. However, because of the increasing density of conductive elements on circuit board, the mounting holes defined in the printed circuit board will complicate designing the circuit routing of the board. Therefore, the cost of the circuit board will increase also.

BRIEF SUMMARY OF THE INVENTION

A main object of the present invention is to provide an electrical connector having a metallic shell therearound for providing EMI protection and for soldering onto a printed circuit board.

To fulfill the above-mentioned object, an electrical connector according to the present invention comprises an insulative housing including a body and an engaging section together defining a plurality of passageways for receiving a plurality of terminals. Each terminal comprises a contacting portion and a soldering portion. A substantially rectangular shell is made from a metallic material. The metallic shell includes a ceiling portion, a bottom portion and a first and second side walls. The shell defines a receiving space for accommodating the insulative housing therein. The ceiling portion defines a retaining hole for engaging with an inserted mating plug. A pair of retention arms is respectively formed in the first and second side wall. Two pairs of soldering pads respectively extend from the lower edge of the first side wall and the second side wall for soldering to a printed circuit board.

Other objects, advantages and novel features of the invention will become more apparent from the following detailed description when taken in conjunction with the accompanying drawings.

DETAILED DESCRIPTION OF THE INVENTION

Figure 1:
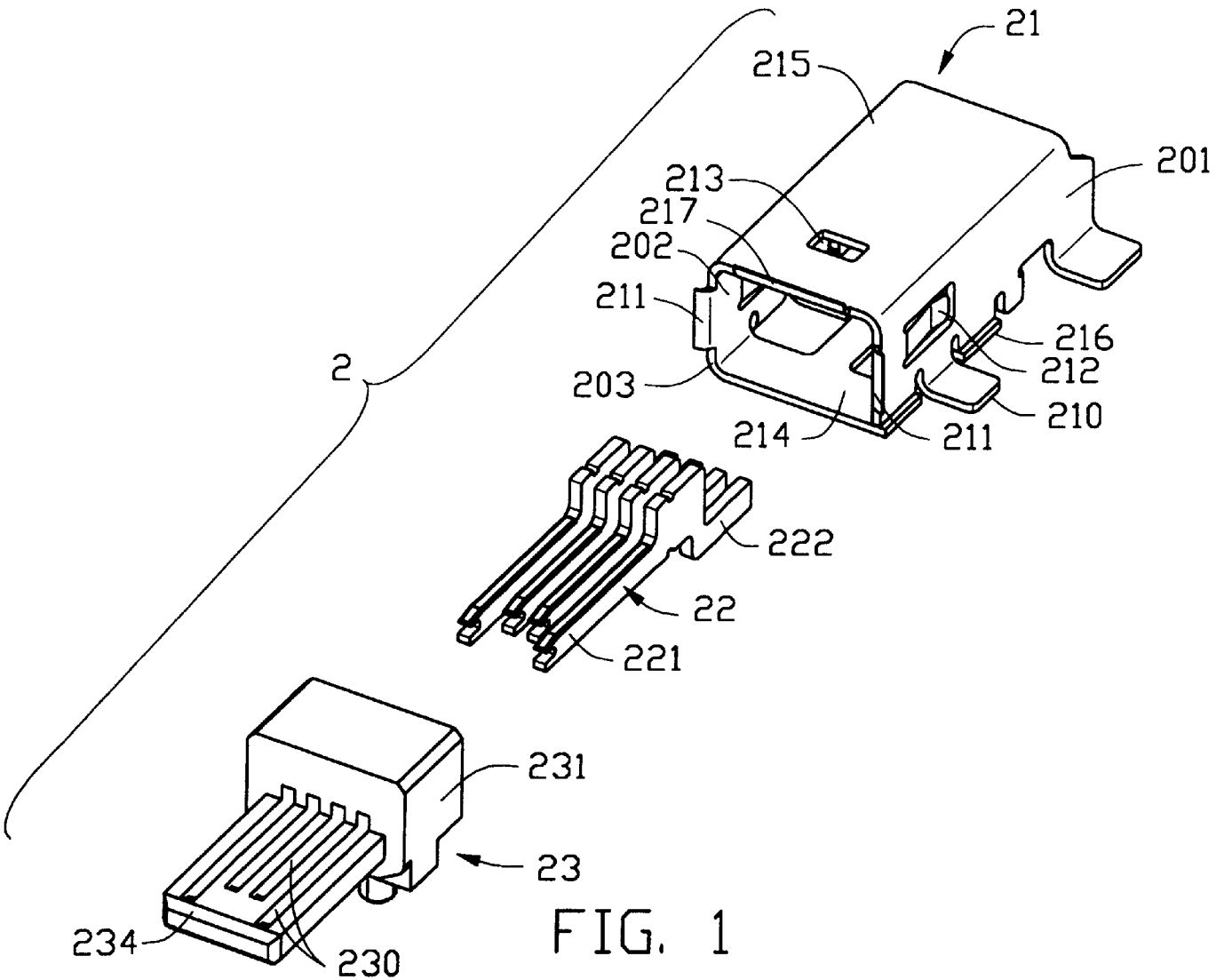
FIG. 1 is an exploded view of an electrical connector in accordance with the present invention.
Figure 2:
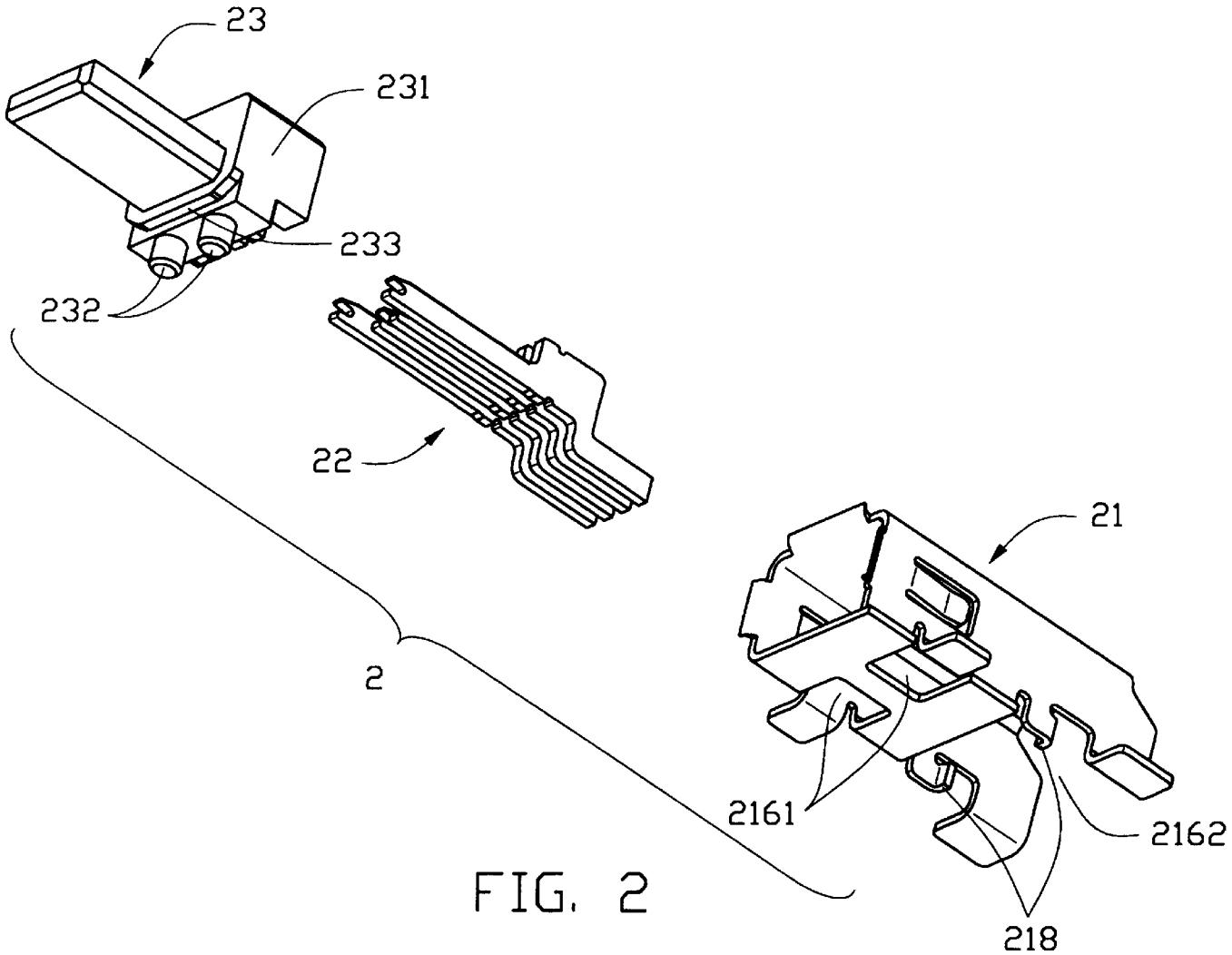
FIG. 2 is the electrical connector of FIG. 1 viewed from a different aspect.
Figure 3:
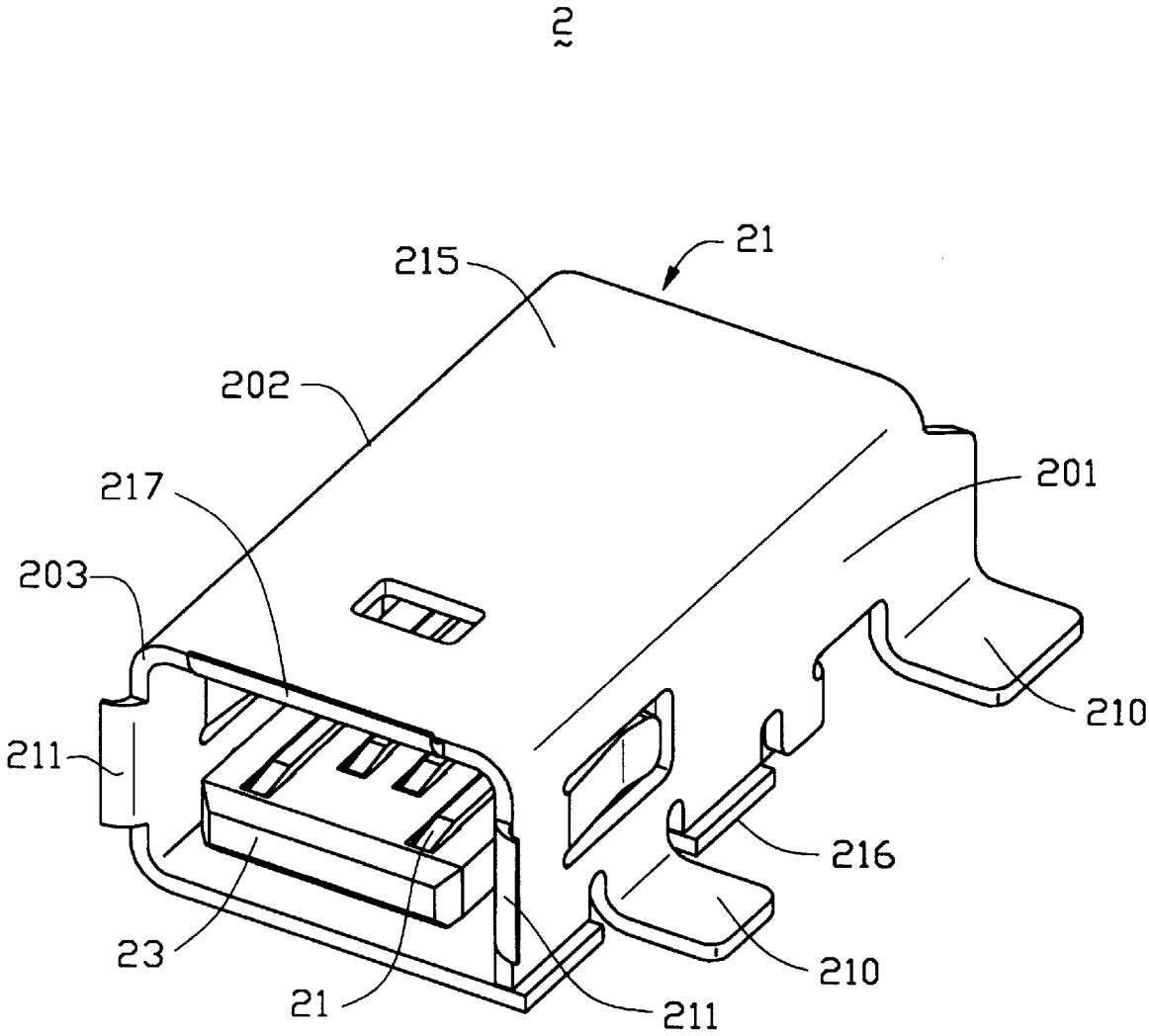
FIG. 3 is an assembled view of FIG. 1.

Referring to FIGS. 1–3, an electrical connector 2 comprises a metallic shell 21, an insulative housing 23 and a plurality of terminals 22. The shell 21 is stamped from a metallic plate. The metallic shell 21 is substantially rectangular and defines a receiving space 214 for receiving the insulative housing 23 therein. The rectangular shell 21 comprises a ceiling portion 215, a bottom portion 216 and a first and second side walls 201, 202. A mating face 203 is defined at a front end of the shell 21. A pair of first arcuate flanges 211 extends from lateral edges of the mating face 215 and a pair of second arcuate flanges 217 extends and bent outwardly from top edge of the mating face 203 for facilitating the insertion of a mating plug (not shown). A pair of retention arms 212 is formed in the first and second side walls 201, 202 for contacting the mating plug.

Two soldering pads 210 extend from a lower edge of the first side wall 201. Other two soldering pads 210 are formed at the lower edge of the second side wall 202. The Ceiling portion 215 of the shell 21 defines a retaining hole 213 therein for securely positioning the inserted mating plug.

The bottom portion 216 defines therein a pair of cutouts 2161 wherein one cutout 2161 is formed by forming one of the front solder pads 210 which is stamped from the bottom portion 216, while the other cutout 2161 is to receive the other of the front solder pads 210 which is stamped from the first side wall 201 for retention consideration. An opening 2162 is exposed on a lower, rear side of the shell 21. A pair of retention bends 218 are respectively formed on the first side wall 201 and the second side wall 202 around the opening 2162, and cooperate with the bottom portion 216 to sandwich the bottom portion of the body 231 therebetween so as to fasten the shell 21 and the housing 23 together wherein the bottom portion of the body 231 defines a recess 233 for receiving the rear edge portion of the bottom portion 216.

Each terminal 22 comprises a contacting portion 221 for electrically contacting connectors of the mating plug and a soldering portion 222 for soldering on a circuit board 3. The soldering portions 222 are received in the opening 2162 between the rear pair of soldering pads 210. The insulative housing 23 comprises a body 231 and an engaging section 234. A plurality of passageways 230 is defined in the engaging section 234 for receiving the terminals 22 therein. A pair of positioning posts 232 is formed on the bottom portion of the body 231 for securing in corresponding holes defined in the circuit board 3.

Figure 4:
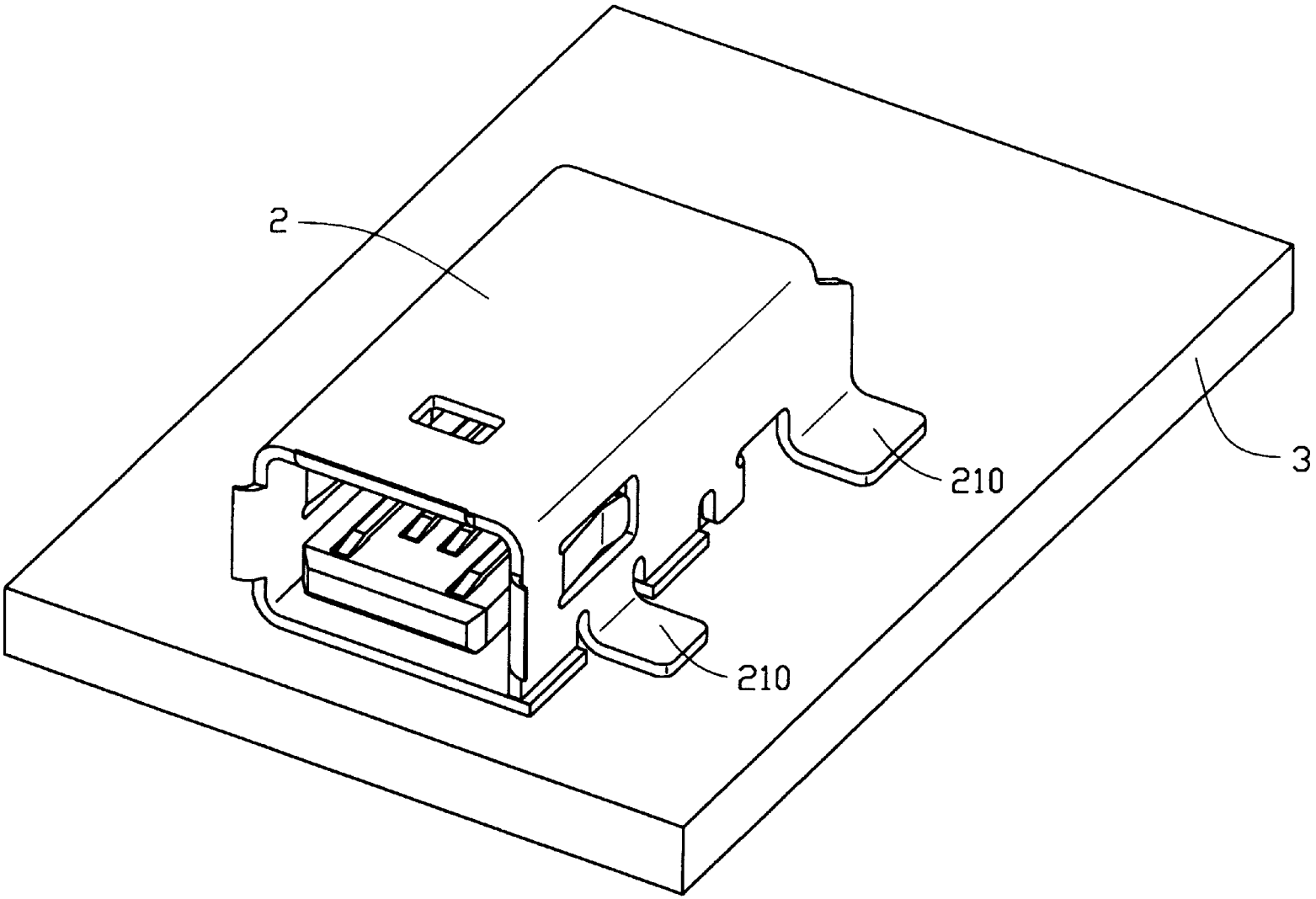
FIG. 4 is a perspective view of the assembled electrical connector mounted to a circuit board.
Figure 5:
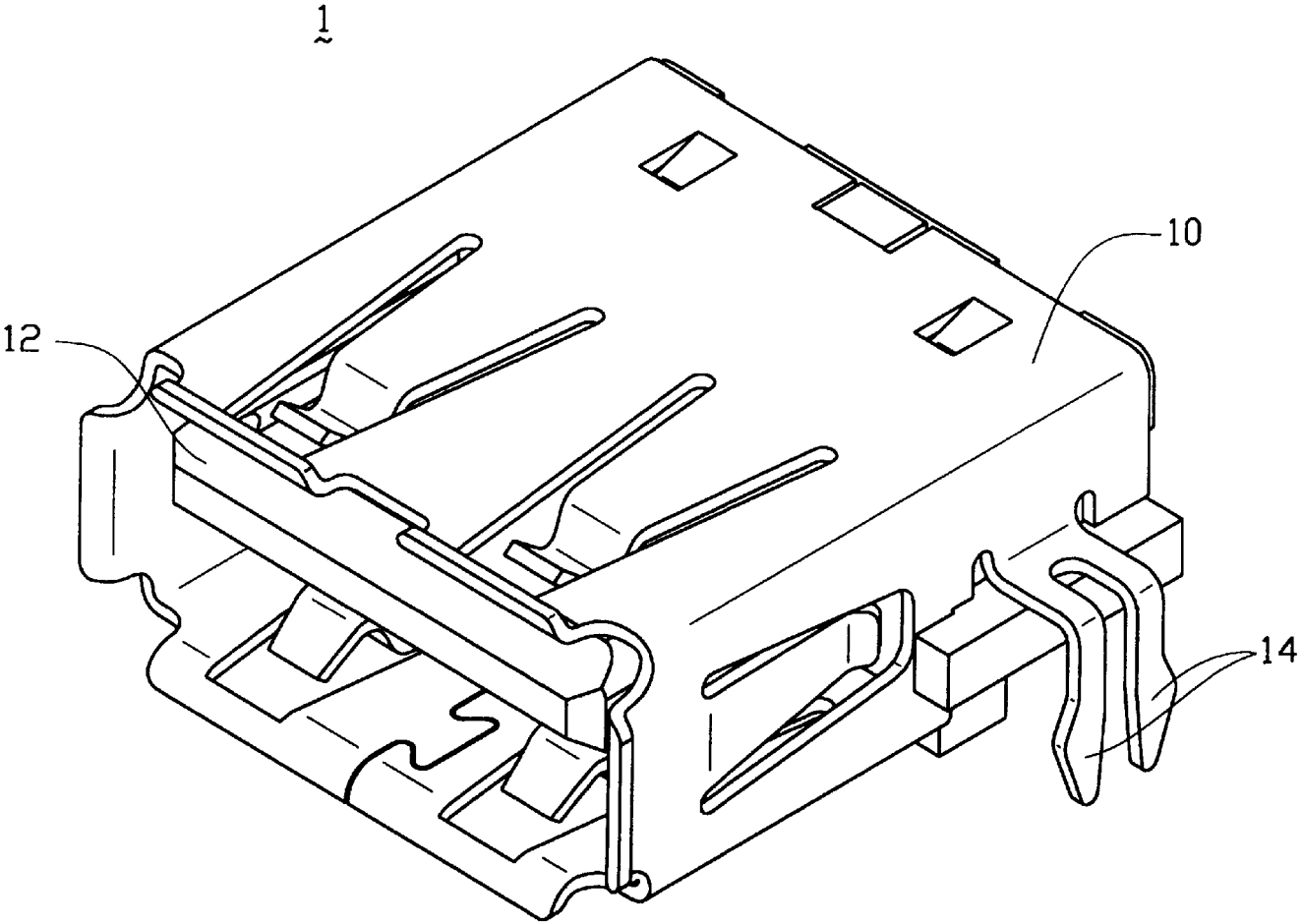
FIG. 5 (PRIOR ART)
FIG. 5 is a perspective view of a conventional electrical connector.

Referring to FIG. 4, after assembly the soldering pads 210 are soldered to the circuit board 3. Therefore, the electrical connector 2 is mounted on the circuit board 3 without the use of board locks penetrating the circuit board 3. The soldering portion 222 of each terminal 22 is soldered to a contact pad of the circuit board 3.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing including a body and an engaging section together defining a plurality of passageways therein;

a plurality of terminals being received in the passageways, each terminal comprising a contacting portion and a soldering portion; and a substantially rectangular shell made from a metallic material including a ceiling portion, a bottom portion and a first and second side walls together defining a receiving space for accommodating the insulative housing therein, the ceiling portion defining a retaining hole for engaging with an inserted mating plug, a pair of retention arms being respectively formed in the first and second side walls, two pairs of soldering pads respectively extending from the lower edge of the first and second side walls for soldering to a printed circuit board;

wherein an opening is exposed downwardly to a rear of the bottom portion for receiving the soldering portions of the terminals;

wherein the bottom portion defines a pair of cutouts therein from which one pair of the soldering pads are bent;

wherein a pair of positioning posts is formed on a bottom of the body of the insulative housing for securing in corresponding holes defined in the circuit board;

wherein a pair of first arcuate flanges extends and curves outwardly from a front edge of the first and second side walls of the shell, and a second arcuate flange extends and curves outwardly from a front edge of the ceiling portion of the shell for facilitating the insertion of a mating plug;

wherein the shell is stamped from a one-piece metallic material to form the ceiling portion, the bottom portion and the first and second side walls whereby a junction portion is formed between the first side wall and the bottom portion.

2. An electrical connector comprising:

an insulative housing including a body and an engaging section; a plurality of terminals received in the housing and extending in a front-to-back direction;

a metal shell defining a receiving space receiving said housing, said shell including a ceiling portion, a bottom portion opposite to said ceiling portion, and a pair of side walls, the bottom portion defining two opposite cutouts;

wherein one of said two cutouts is defined by forming a first front solder pad which is stamped from the bottom portion and extends laterally outwardly from one of said pair of side walls, while the other of said two cutouts is define by forming a second front solder pad which is stamped from the other of said pair of side walls and extends laterally outwardly form the other of said pair of side walls;

wherein a rear pair of solder pads are respectively formed on said pair of side walls behind said first and second solder pads;

wherein a pair of retention bends are respectively formed on said pair of side walls, and one of said pair of retention bends is positioned between the first front solder pad and one of said rear pair of solder pads, and the other of said pair of retention bends is positioned between the second front solder pad and the other of said rear pair of solder pads.

* * * * *